US009333551B2

(12) United States Patent
Folke et al.

(10) Patent No.: US 9,333,551 B2
(45) Date of Patent: May 10, 2016

(54) DEVICE FOR SEPARATING BAND STRIPS OF A LONGITUDINALLY DIVIDED BAND, PARTICULARLY A METAL BAND

(75) Inventors: Thomas Folke, Siegen (DE); Wolfgang Runkel, Siegen (DE)

(73) Assignee: HEINRICH GEORG GMBH MASCHINENFABRIK, Kreuztal (DE)

( * ) Notice: Subject to any disclaimer, the term of this patent is extended or adjusted under 35 U.S.C. 154(b) by 1056 days.

(21) Appl. No.: 13/378,855

(22) PCT Filed: Jun. 16, 2010

(86) PCT No.: PCT/EP2010/058436

§ 371 (c)(1),
(2), (4) Date: Mar. 2, 2012

(87) PCT Pub. No.: WO2010/146073

PCT Pub. Date: Dec. 23, 2010

(65) Prior Publication Data

US 2012/0152074 A1 Jun. 21, 2012

(30) Foreign Application Priority Data

Jun. 17, 2009 (DE) ..... 10 2009 025 133

(51) Int. Cl.
*B21D 43/28* (2006.01)

(52) U.S. Cl.
CPC ..... *B21D 43/287* (2013.01); *Y10T 83/162* (2015.04)

(58) Field of Classification Search
USPC ..... 242/615.1; 83/665
See application file for complete search history.

(56) References Cited

U.S. PATENT DOCUMENTS

| | | | | |
|---|---|---|---|---|
| 3,422,714 | A | 1/1969 | Van Gompel et al. | |
| 3,488,479 | A | 1/1970 | Keyes et al. | |
| 3,786,705 | A * | 1/1974 | Dorfel | 83/76.7 |
| 4,607,552 | A | 8/1986 | Siler | |
| 6,012,372 | A * | 1/2000 | Laster et al. | 83/665 |

(Continued)

FOREIGN PATENT DOCUMENTS

| | | | |
|---|---|---|---|
| CN | 1341046 | A | 3/2002 |
| CN | 2499192 | Y | 7/2002 |

(Continued)

OTHER PUBLICATIONS

PCT, English Translation of the International Preliminary Report on Patentability, International Application No. PCT/EP2010/058436, Jan. 5, 2012.

(Continued)

*Primary Examiner* — Emmanuel M Marcelo
*Assistant Examiner* — Angela K Caligiuri
(74) *Attorney, Agent, or Firm* — Quarles & Brady LLP

(57) ABSTRACT

A device for separating band strips of a longitudinally divided band includes a stationary separating shaft having separating discs arranged on the separating shaft. The separating discs are positioned on the separating shaft, such that the separating discs are mutually spaced apart by distances that correspond to a band strip width of band strips being separated. A clamp integrated into the separating shaft clamps the positioned separating discs on the separating shaft. A disc positioner automatically positions the separating discs on the separating shaft in accordance with a cutting program, wherein the disc positioner is integrated into the separating shaft in addition to the clamp clamping the separating discs on the separating shaft.

7 Claims, 2 Drawing Sheets

(56) References Cited

U.S. PATENT DOCUMENTS

| | | | | |
|---|---|---|---|---|
| 6,631,663 | B1 * | 10/2003 | Hutzenlaub | 83/496 |
| RE40,349 | E * | 6/2008 | Blum et al. | 83/425.4 |

FOREIGN PATENT DOCUMENTS

| | | | |
|---|---|---|---|
| DE | 2844569 | A1 | 4/1979 |
| DE | 8802161 | U1 | 4/1988 |
| DE | 3820997 | A1 | 12/1989 |
| DE | 19607478 | C1 | 8/1997 |
| DE | 19959333 | A1 | 6/2001 |
| DE | 10331023 | A1 | 2/2005 |
| DE | 102005010948 | B4 | 10/2007 |
| DE | 102009025133 | B3 | 12/2010 |
| EP | 1238935 | A2 | 9/2002 |

OTHER PUBLICATIONS

State Intellectual Property Office of People'S Republic of China, First Office Action and Search Report, CN 201080027328.2, Jul. 2, 2013.

International Search Report under date of mailing of Dec. 10, 2010 in connection with PCT/EP2010/058436.

* cited by examiner

DEVICE FOR SEPARATING BAND STRIPS OF A LONGITUDINALLY DIVIDED BAND, PARTICULARLY A METAL BAND

CROSS-REFERENCE TO RELATED APPLICATIONS

This application represents the national stage entry of PCT International Application No. PCT/EP2010/058436 filed Jun. 16, 2010 which claims the benefit of German Patent Application 10 2009 025 133.2 filed Jun. 17, 2009, both of which are hereby incorporated herein by reference for all purposes.

STATEMENT REGARDING FEDERALLY SPONSORED RESEARCH OR DEVELOPMENT

Not applicable.

FIELD OF THE INVENTION

The invention pertains to a device for separating band strips of a longitudinally divided band, particularly a metal band, with separating discs that are arranged on a separating shaft and can be positioned such that they are mutually spaced apart by distances that correspond to the width of the band strips, and with a device that is integrated into the separating shaft and serves for clamping the positioned separating discs on the separating shaft.

BACKGROUND OF THE INVENTION

In systems for longitudinally dividing bands, band coils are cut into band strips by means of slitting shears and subsequently wound up into the split rings. Separating shafts of the initially cited type are used fir the further transport of the band strips to a winding machine downstream of the slitting shears. These separating shafts prevent the individual band strips from overlapping and ensure a straight run thereof.

DE 88 02 161 U1 describes a separating shaft of the initially cited type with separating discs that are seated on supporting rings and can be positioned such that they are mutually spaced apart. A radially expandable cylinder with a clearance space that can be subjected to hydraulic pressure is seated on the separating shaft in a concentric and sealed fashion, wherein the supporting rings for accommodating the separating discs are seated on this expandable cylinder and held thereon with a press fit when the cylinder is expanded. The disadvantage of this known separating shaft is that the supporting ring segments of the separating discs need to be manually positioned on the separating shaft by a mechanic.

In one known separating shaft, the separating discs are seated on the separating shaft together with spacer rings that correspond to the band widths and jointly fixed in position. The shaft is removed from the production facility manually or by means of a device and manually assembled in accordance with the cutting program. The preassembly of separating shafts with separating discs and spacer rings requires high personnel expenditure and equipment availability.

There also exist systems, in which the separating discs are displaced into the position defined by the cutting program and then clamped on the shaft with pneumatic clamping pads by means of a motorized manipulator that is arranged outside the separating shaft. The disadvantage of these known systems can be seen in that the use of external manipulators in connection with pneumatic clamping shafts is limited to new systems because the structural space required for a manipulator is typically not available in existing systems. This complicates the modernization of existing systems.

DE 103 31 023 A1 and DE 38 20 997 C2 describe devices for separating band strips of a longitudinally divided metal band by means of cam rollers.

DE 199 59 333 B4 discloses a device for separating band strips by means of rings with different diameters.

DE 196 07 478 C1 discloses a device, in which the separation of the band strips is realized with pivoted blades.

SUMMARY OF THE INVENTION

The invention is based on the objective of developing a device of the initially cited type for separating band strips of a longitudinally divided band which makes it possible to automatically position the separating discs on the separating shaft and requires no additional structural space.

According to the invention, this objective is attained with a separating device including a stationary separating shaft having separating discs arranged on the separating shalt. The separating discs are positioned on the separating shaft, such that the separating discs are mutually spaced apart by distances that correspond to a band strip width of band strips being separated. A clamp integrated into the separating shaft clamps the positioned separating discs on the separating shaft. A disc positioner automatically positions the separating discs on the separating shaft in accordance with a cutting program, wherein the disc positioner is integrated into the separating shaft in addition to the clamp clamping the separating discs on the separating shaft.

In a preferred embodiment of the invention, a first transport carriage is movable parallel to a longitudinal axis of the separating shaft in a first guide groove of the separating shaft by a motor drive. The first transport carriage includes a radially extendible gripper that radially extends from and retracts into the separating shaft in order to take hold of a separating disc to be transported into a position on the separating shaft defined by a cutting program by the transport carriage and to release the positioned separating disc. Advantageous and practical additional developments of the invention are disclosed herein.

BRIEF DESCRIPTION OF THE DRAWINGS

The invention is elucidated below with reference to the drawings, in which.

DETAILED DESCRIPTION OF THE EXAMPLE EMBODIMENTS

Figure 1:
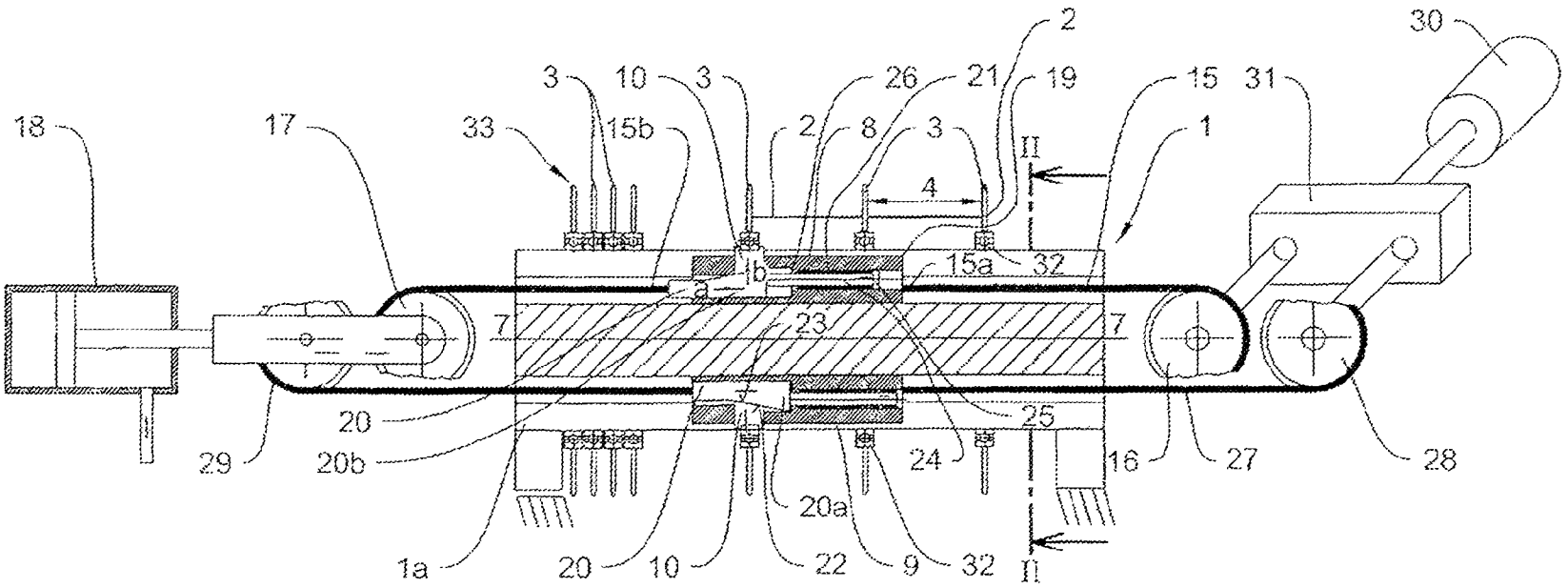
FIG. 1 shows a longitudinal section through a separating shaft for separating band strips of a longitudinally divided metal band.
Figure 2:
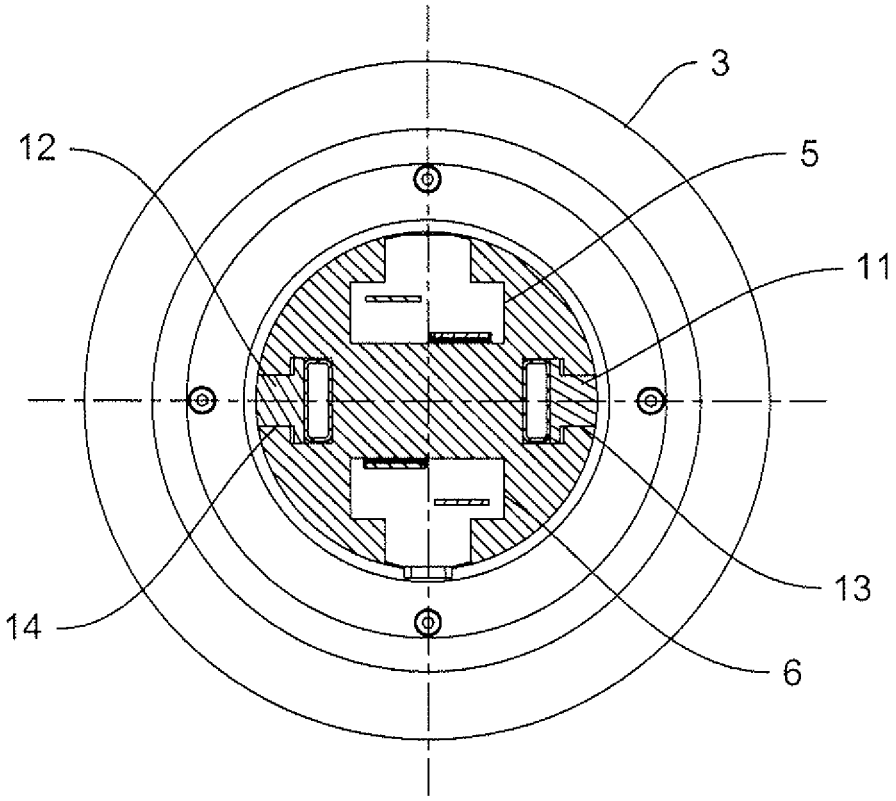
FIG. 2 shows an enlarged cross section through the separating shaft along the line of section II-II in FIG. 1.

The stationary separating shaft 1 for separating band strips 2 of a longitudinally divided metal strip is equipped with separating discs 3 that can be positioned on the separating shaft 1 such that they are mutually spaced apart by distances 4 that correspond to the width of the band strips.

Two diagonally opposite transport carriages 8, 9 that can be displaced parallel to the axis 7-7 of the separating shaft 1 in guide grooves 5, 6 by means of a drive and respectively feature a gripper 10 that can be radially extended from and retracted into the separating shaft 1 in order to take hold of a separating disc 3 to be transported into a position on the separating shaft 1 defined by a cutting program by means of the transport carriages 8, 9 and to release the positioned separating disc, as well as two pneumatic clamping bars 11, 12 that are offset relative to the transport carriages 8, 9 by 90°, are integrated into the separating shaft 1. The clamping bars 11, 12 extend in the direction of the axis 7-7 of the separating shaft 1 and can be radially extended out of the separating shaft 1 through longitudinal slots 13, 14 arranged therein in order to clamp the positioned separating discs 3 on the separating shaft 1.

The drive of the first transport carriage 8 is realized with a revolving tension element 15 that extends over a driving pulley 16 and a deflecting and tensioning pulley 17 that can be adjusted in the direction of the axis 7-7 of the separating shaft 1 by means of a hydraulic actuating cylinder 18. The tension element 15 is divided, wherein one end 15*a* of the tension element 15 is fixed on the housing 19 of the transport carriage 8 and the other end 15*b* of the tension element 15 is fixed on a control slide 20 that is displaceably guided parallel to the axis 7-7 of the separating shaft 1 in the transport carriage 8.

The control slide 20 is connected to the housing 19 of the transport carriage 8 by means of a tensioning spring 21 and features an outwardly directed, inclined actuating surface 22 that cooperates with a corresponding inwardly directed, inclined counter surface 23 of the gripper 10 in such a way that the tensioning spring 21 causes control slide 20 with the actuating surface 22 to assume a position 20*a*, in which the second transport carriage 9 is illustrated and in which the gripper 10 is retracted into the separating shaft 1, when the tension element 15 is subjected to a certain prestress by the actuating cylinder 18.

When the tensile stress of the tension element 15 is increased by the actuating cylinder 18, the gripper 10 is extended from the separating shaft 1 in the direction of the arrow b by the control slide 20 that moves into the position 20*b* in the direction of the arrow a opposite to the direction of action of the tensioning spring 21.

The tensioning spring 21 in the form of a pressure spring is seated on a guide pin 24 of the control slide 20 and braced against a limit stop washer 25 of the guide pin 24 with one end and against a web 26 of the housing 19 of the transport carriage 8 with the other end.

The drive of the second transport carriage 9 that is structurally identical to the first transport carriage 8 is realized in the form of a second tension element 27 that extends over a driving pulley 28 and a deflecting and tensioning pulley 29 that can be adjusted in the direction of the axis 7-7 of the separating shaft 1 together with the deflecting and tensioning pulley 17 of the drive of the first transport carriage 8 by means of the hydraulic actuating cylinder 18 in order to increase the tensile stress of both tension elements 15, 27.

The driving pulleys 16, 28 of the tension elements 15, 27 of the two transport carriages 8, 9 with the grippers 10 are driven by a controlled driving motor 30 and a synchronizing gear 31 or by two electronically synchronized driving motors in order to synchronously drive the driving pulleys 16, 28 of the tension elements 15, 27 of both transport carriages 8, 9 for positioning a separating disc 3.

The separating discs 3 are rotatably supported on the stationary separating shaft 1 by means of rolling bearings 32.

Not-shown transport rollers arranged upstream and downstream of the separating shaft 1 ensure that the band strip 2 runs a certain distance above the rolling bearings 32 of the separating discs 3 in order to avoid edge tracks on the band strips.

An end section 1*a* of the separating shaft 1 serves as a magazine 33 for storing the separating discs 3 to be positioned.

The above-described separating shaft with two transport carriages that respectively feature a gripper for positioning the separating rings is preferably used for processing band strips that are narrow in relation to the diameter of the separating shaft in order to prevent the functionally narrow separating rings from tilting.

A separating shaft with one transport carriage that features one gripper for positioning the separating discs may be used for processing wider band strips. In other embodiments of the separating shaft, the transport carriage with the gripper for positioning the separating discs is displaced by a spindle, a toothed rack or a pressure cylinder.

Another embodiment of the separating shaft is characterized by at least one transport carriage that can be displaced parallel to the axis of the separating shaft in a guide groove of the separating shaft by means of a motor drive and features an electromagnet that can be switched on and off in order to take hold of a separating disc to be transported into a position on the separating shaft defined by a cutting program by means of the transport carriage and to release the positioned separating disc.

The invention claimed is:

1. A device for separating band strips of a longitudinally divided band, said device comprising:

a stationary separating shaft;

separating discs arranged on the separating shaft, said separating discs being positioned on said separating shaft such that the separating discs are mutually spaced apart by distances that correspond to a band strip width of band strips being separated;

a clamp integrated into the separating shaft clamping the positioned separating discs on the separating shaft:

a disc positioner automatically positioning the separating discs on the separating shaft in accordance with a cutting program, wherein said disc positioner is integrated into the separating shaft in addition to the clamp clamping the separating discs on the separating shaft; and a first transport carriage movable parallel to a longitudinal axis of the separating shaft in a first guide groove of the separating shaft by a motor drive, said first transport carriage including a radially extendible gripper that radially extends from and retracts into the separating shaft in order to take hold of a separating disc to be transported into a position on the separating shaft defined by a cutting program by the transport carriage and to release the positioned separating disc, wherein the first transport carriage includes a revolving tension element that extends over a driving pulley and a deflecting and tensioning pulley adjustable in the direction of a longitudinal axis of the separating shaft by a hydraulic actuating cylinder, wherein the tension element is divided, wherein one end of the tension element is fixed on a housing of the first transport carriage and another end of the tension element is fixed on a control slide that is displaceably guided parallel to the longitudinal axis of the separating shaft in the first transport carriage and connected to the housing of the first transport carriage by means of a tensioning spring, wherein said control slide features an outwardly directed, inclined actuating surface that cooperates with a corresponding inwardly directed, inclined counter surface of the gripper in such a way that the tensioning spring causes the control slide with the actuating surface to assume a position, in which the gripper is retracted into the separating shaft, when the tension element is subjected to a certain prestress by the actuating cylinder, and wherein the gripper is extended from the separating shaft by the control slide that moves opposite to the direction of action of the tensioning spring when the tensile stress of the tension element is increased by the actuating cylinder.

2. The device according to claim 1, including a second transport carriage with a gripper that is arranged diagonally opposite the first transport carriage with a gripper for the separating discs to be positioned, wherein the second transport carriage is movable parallel to the longitudinal axis of the separating shaft in a second guide groove of the separating shaft, by a drive of the second transport carriage in the form of a second tension element that extends over a driving pulley and a deflecting and tensioning pulley adjustable in the direction of the axis of the separating shaft together with the deflecting and tensioning pulley of the drive of the first transport carriage by means of the hydraulic actuating cylinder in order to increase the tensile stress of both tension elements, and by a controlled driving motor and a synchronizing gear or two electrically synchronized driving motors in order to synchronously drive the driving pulleys of the tension elements of both transport carriages for positioning a separating disc by means of both transport carriages.

3. The device according to claim 2, including two clamping bars installed into the separating shaft such that the clamping bars are offset relative to the first and second transport carriages by 90°, wherein said clamping bars extend in the direction of the longitudinal axis of the separating shaft and are radially extendable out of the separating shaft through longitudinal slots formed in the separating shaft in order to clamp the positioned separating discs on the separating shaft.

4. The device according to claim 1, in which the separating discs are rotatably supported on the separating shaft by rolling bearings.

5. The device according to claim 1, in which at least an end section of the separating shaft serves as a magazine for storing the separating discs to be positioned.

6. The device according to claim 1, including a spindle, a toothed rack or a pressure cylinder for displacing the first transport carriage with the gripper in order to position the separating discs on the separating shaft.

7. A device for separating band strips of a longitudinally divided band, said device comprising:

a stationary separating shaft;

separating discs arranged on the separating shaft, said separating discs being positioned on said separating shaft such that the separating discs are mutually spaced apart by distances that correspond to a band strip width of band strips being separated;

a clamp integrated into the separating shaft clamping the positioned separating discs on the separating shaft;

a disc positioner automatically positioning the separating discs on the separating shaft in accordance with a cutting program, wherein said disc positioner is integrated into the separating shaft in addition to the clamp clamping the separating discs on the separating shaft; and at least one transport carriage displaceable parallel to the axis of the separating shaft in a guide groove of the separating shaft by a motor drive and features a gripper including an electromagnet that can be switched on and off in order to take hold of a separating disc to be transported into a position on the separating shaft defined by a cutting program by means of the transport carriage and to release the positioned separating disc, wherein the at least one transport carriage includes a revolving tension element that extends over a driving pulley and a deflecting and tensioning pulley adjustable in the direction of a longitudinal axis of the separating shaft by a hydraulic actuating cylinder, wherein the tension element is divided, wherein one end of the tension element is fixed on a housing of the at least one transport carriage and another end of the tension element is fixed on a control slide that is displaceably guided parallel to the longitudinal axis of the separating shaft in the at least one transport carriage and connected to the housing of the at least one transport carriage by means of a tensioning spring, wherein said control slide features an outwardly directed, inclined actuating surface that cooperates with a corresponding inwardly directed, inclined counter surface of the gripper in such a way that the tensioning spring causes the control slide with the actuating surface to assume a position, in which the gripper is retracted into the separating shaft, when the tension element is subjected to a certain prestress by the actuating cylinder, and wherein the gripper is extended from the separating shaft by the control slide that moves opposite to the direction of action of the tensioning spring when the tensile stress of the tension element is increased by the actuating cylinder.

* * * * *

UNITED STATES PATENT AND TRADEMARK OFFICE

CERTIFICATE OF CORRECTION

PATENT NO. : 9,333,551 B2
APPLICATION NO. : 13/378855
DATED : May 10, 2016
INVENTOR(S) : Thomas Folke et al.

It is certified that error appears in the above-identified patent and that said Letters Patent is hereby corrected as shown below:

In the specification,
Column 1, Line 36: "fir" should be --for--
Column 2, Line 20: "shalt" should be --shaft--

Signed and Sealed this
Twelfth Day of July, 2016

Michelle K. Lee

Michelle K. Lee
*Director of the United States Patent and Trademark Office*